US006598589B2

(12) United States Patent
Frelund et al.

(10) Patent No.: US 6,598,589 B2
(45) Date of Patent: Jul. 29, 2003

(54) ENGINE CONTROL ALGORITHM-COLD START A/F MODIFIER

(75) Inventors: Arthur R. Frelund, Okemos, MI (US); Jay Tolsma, Grand Ledge, MI (US)

(73) Assignee: General Motors Corporation, Detroit, MI (US)

( * ) Notice: Subject to any disclaimer, the term of this patent is extended or adjusted under 35 U.S.C. 154(b) by 147 days.

(21) Appl. No.: 09/817,916

(22) Filed: Mar. 26, 2001

(65) Prior Publication Data

US 2002/0134356 A1 Sep. 26, 2002

(51) Int. Cl.[7] ..... F02M 51/00

(52) U.S. Cl. ..... 123/435; 123/436; 123/491; 123/685

(58) Field of Search ..... 123/435, 436, 123/685, 686, 491

(56) References Cited

U.S. PATENT DOCUMENTS 5,537,978 A * 7/1996 Watanabe et al. ..... 123/435
5,586,537 A * 12/1996 Tomisawa et al. ..... 123/435
5,817,923 A * 10/1998 Ohsaki et al. ..... 123/1 A
5,957,994 A * 9/1999 Meyer et al. ..... 123/352
6,079,396 A * 6/2000 Ament et al. ..... 123/491
6,283,102 B1 * 9/2001 Nelson et al. ..... 123/1 A
6,360,726 B1 * 3/2002 Javaherian ..... 123/435
2002/0104521 A1 * 8/2001 Maloney et al. ..... 123/686

* cited by examiner

*Primary Examiner*—Erick Solis
(74) *Attorney, Agent, or Firm*—Anthony Luke Simon

(57) ABSTRACT

A method and apparatus for controlling the amount of fuel used in combustion during open-loop run mode of a internal combustion engine. A lookup table calibrated to a fuel with a low driveability index is used to make a fueling decision for open-loop run mode. Then, at least one of the following indicators of fuel problems is monitored: the engine misfire detection system, the engine speed and the manifold absolute pressure. If any of these indicators detect a problem with the amount of fuel the engine is receiving, a fuel increase is calculated and implemented in one or more steps. A problem is indicated if an engine misfire is detected, the engine speed drops below a predetermined threshold value, or the manifold absolute pressure rises above a predetermined threshold value. The fuel increase is limited by a calculation based upon a fuel with a high driveability index.

19 Claims, 1 Drawing Sheet

ENGINE CONTROL ALGORITHM-COLD START A/F MODIFIER

BACKGROUND OF THE INVENTION

1. Field of the Invention

The present invention relates, in general, to internal combustion engine control systems and, specifically, to an internal combustion engine control system capable of controlling the air-to-fuel ratio upon a cold start of the engine.

2. Description of the Art

When an engine is cranked upon startup, the engine controller compares the value from the coolant temperature sensor with values stored in a lookup table to determine the correct air/fuel (A/F) ratio at that temperature. Typically, the fuel control system provides an A/F ratio of between 2:1 to 12:1, depending on the temperature. Upon a cold start, the controller switches to an open-loop run mode shortly after engine crank mode is complete. The A/F ratio during open-loop run mode is rich and is also determined from a lookup table incorporating start-up coolant temperature. The controller continues this open-loop run mode until the engine is warmed up. Generally, the engine is warmed up when it reaches a total warm-up time derived from a look-up table based on the start-up coolant temperature and current coolant temperature. When the engine is warmed up, or immediately upon a warm start, the controller switches to closed-loop fuel control, assuming the exhaust gas oxygen sensor is sufficiently warmed. If the controller is unable to switch to closed-loop fuel control, open-loop fuel control continues using an A/F ratio of close to stoichiometric, 14.7.

Currently, the lookup table used for open-loop run mode is calibrated to a fuel with a high driveability index ("DI"). Driveability index is an indicator of the amount of heat required to evaporate a particular fuel. The higher the DI, the more heat is required to evaporate the fuel. The majority of fuels have a DI from 1100 to 1150, however, the calibration of the lookup table typically is performed using a "worst case fuel of 1250 DI. As a consequence of calibrating the lookup table to a fuel with such a high DI, the engine is required to run richer than required if the lookup table was calibrated to a fuel with a better driveability index. This rich mixture facilitates a rapid, smooth start-up regardless of the DI of the fuel. If insufficient fuel is used during this period, engine misfires or stalls could result.

Because the catalytic converter does not begin processing emissions from the engine until the converter reaches an appropriate operating temperature and exhaust has excess oxygen to oxidize HC and CO, this additional fuel translates directly into higher emissions, specifically HC (hydrocarbon) and CO (carbon monoxide) during open-loop run mode. One solution to this problem is to heat up the converter faster. For example, an air injection reaction system injects air into the exhaust to produce an exotherm and thereby raises exhaust gas and converter temperature. This increases the operating temperature of the engine rapidly and adds excess oxygen to the exhaust, raising exhaust gas and converter temperature. However, the system requires the addition of an air pump and plumbing, increasing engine expense complexity.

SUMMARY OF THE INVENTION

The present invention provides a method and apparatus that allows leaner initial operation of an engine during open-loop run mode. The present invention recognizes that calibrating the lookup table used in determining fuel supplied during the open-loop run mode to a fuel with a low driveability index ("DI") will provide indicators to the engine of inadequate fueling if the engine is using a fuel with a high DI. Therefore, the invention uses an open loop A/F lookup table calibrated to a fuel with a low DI and monitors certain engine indicators of fuel problems, such as the engine misfire detection system, engine speed and/or manifold absolute pressure during open-loop run mode to determine if additional fuel is needed.

Specifically, the method of the present invention controls the air-to-fuel ratio in an internal combustion engine during open-loop run mode by: fueling the engine to an air-to-fuel ratio based on a fuel with a low driveability index, preferably 1100–1150 DI; monitoring at least one engine indicator to detect a problem with the air-to-fuel ratio; and increasing a level of fuel supplied to the engine to a maximum fuel level when the monitoring step shows a problem with the existing air-to-fuel ratio. In one aspect of the invention, the maximum fuel level is determined based on a fuel with a high driveability index, preferably 1250 DI.

The apparatus of the present invention controls the air-to-fuel ratio in an internal combustion engine during open-loop run mode, using means for fueling the engine to an air-to-fuel ratio based on a fuel with a low driveability index; means for monitoring at least one engine indicator to detect a problem with the air-to-fuel ratio; and means for increasing a level of fuel supplied to the engine to a maximum fuel level when the monitoring step shows the problem with the air-to-fuel ratio. predetermined threshold speed, or when the manifold absolute pressure rises above a predetermined threshold pressure. Alternatively, any one of these systems could be used to detect a problem.

In another aspect of the invention, increasing the level of fuel supplied to the engine to a maximum fuel level takes place in more than one incremental step.

By fueling the engine based on a fuel with a low DI during open-loop run mode, the present invention is intended to result in leaner operation of most engines during open-loop run mode, resulting in a reduction of HC emissions produced by the engine. Since relatively few vehicles are supplied with a fuel with a high DI, additional fueling events as a result of this change are expected to be minimal.

BRIEF DESCRIPTION OF THE DRAWINGS

The various features, advantages and other uses of the present invention will become more apparent by referring to the following detailed description and drawings in which.

DETAILED DESCRIPTION OF THE PREFERRED EMBODIMENTS

Figure 1:
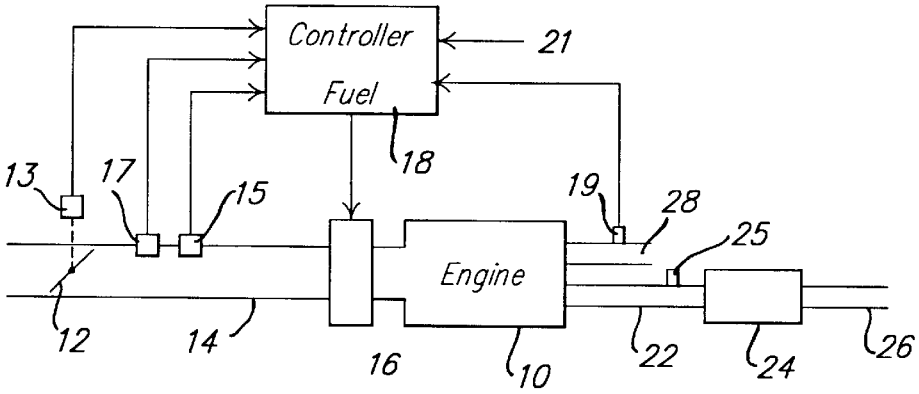
FIG. 1 is a pictorial diagram of an engine and engine control hardware involved in carrying out the present invention.

Referring to FIG. 1, an internal combustion engine 10 receives intake air through a throttle 12 to an intake manifold 14 for distribution to engine cylinder intake air runners (not shown). In the spark-ignition engine, a fuel metering system 16 meters fuel for mixing with the intake air to form air/fuel mixtures flowing into the engine through the intake manifold 14. A FUEL signal, sent from an engine controller 18 to the fuel metering system 16, controls the amount of fuel in the air/fuel mixtures. The air/fuel mixtures are ignited in the engine cylinders (not shown) by an electrical spark produced by a spark plug (not shown) disposed in each cylinder. Exhaust gases produced in the engine cylinder combustion process flow out of engine cylinders and through one or more exhaust gas conduits 22. The exhaust gases then pass through a catalyst, typically located in a catalytic converter 24, and are emitted through a tailpipe 26.

Associated with the engine 10 are various conventional sensors known in the art, which provide typical signals related to engine control. Coupled to the throttle 12 is a throttle position sensor 13. The intake manifold 14 contains an air pressure sensor 15 for measuring manifold absolute pressure (MAP) and a temperature sensor 17, for measuring intake air temperature. Engine speed is determined from a sensor 19, which is attached to and detects the rotations of the crankshaft 28. Also reported is a crankshaft position signal generated by a sensor 19 as the crankshaft rotates. Typically, a crankshaft position sensor might include a sensing device, such as a magnetic, optical, Hall effect, or other, mounted on the engine 10 which detects the presence of a series of teeth or marks located on the engine crankshaft during rotation of the crankshaft. Another sensor, not shown in FIG. 1, provides a coolant temperature signal 21. A conventional exhaust gas oxygen sensor 25 is disposed in the exhaust stream to provide a measure of exhaust oxygen content and is used by the controller 18 to control the air/fuel (A/F) ratio in closed-loop fuel control.

The controller 18 may be a conventional microcontroller which includes such elements as a central processing unit (CPU), read only memory, random access memory, input/output control circuitry, and analog to digital conversion circuitry. The controller 18 is activated upon application of ignition power to an engine. When activated, the controller 18 carries out a series of operations stored in an instruction-by-instruction format in memory for providing engine control, diagnostic and maintenance operations. For example, the controller 18 uses the coolant temperature to determine the initial FUEL signal sent to the engine 10 upon engine crank. The controller 18 also includes a conventional misfire detector, based on crankshaft speed fluctuations as measured by a crankshaft position sensor as described above. Short reduction of rotational speed of the crankshaft typically result from a misfire condition in one of the engine cylinders.

Figure 2:
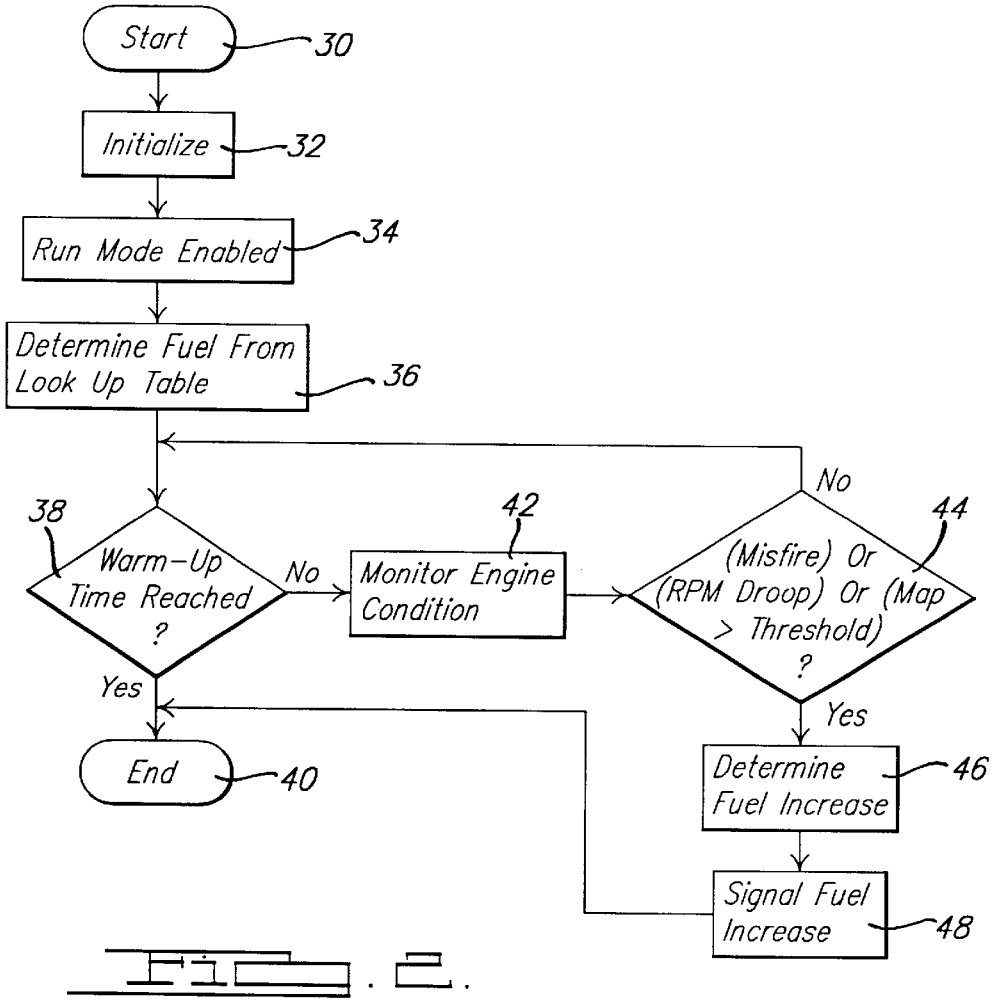
FIG. 2 is a block diagram illustrating a flow of operations for carrying out a method of this invention using the hardware of FIG. 1.

Generally, this procedure provides for control of the amount of fuel input into the engine 10 after engine crank and prior to closed-loop fuel control to minimize emissions and maximize fuel efficiency. More specifically, such an control sequence is initiated at step 30 in FIG. 2 upon application of ignition power to a previously inactive controller 18 and proceeds to carry out general initialization operations in step 32. Such initialization operations include setting pointers, flags, registers and RAM variables to their starting values. These starting values could be predetermined or learned and stored from previous operating events such that they can be used for the next event without having to relearn from a pre-established baseline. In particular, the start-up coolant temperature is obtained during initialization. Further, total warm-up time is determined, preferably from a lookup table incorporating start-up coolant temperature and intake air temperature. Total warm-up time is the total amount of time that passes until the controller attempts to operate in closed-loop fuel control.

When the engine is started cold, engine operation in open-loop run mode is enabled in step 34. In general, open-loop run mode is enabled within 0.5–1.5 seconds after engine crank, corresponding to an engine speed of anywhere from approximately 200–400 rpm. In step 36, the control sequence uses a lookup table based on start-up coolant temperature to determine the amount of fuel to be added to the intake air for combustion. The lookup table is calibrated to a fuel with a low DI, preferably 1100–1150. If the engine is started warm, the engine attempts to operate in closed-loop fuel control immediately after engine crank, without entering open-loop run mode.

In step 38, a query is made as to whether the total warm-up time determined in the initialization of step 32 has been reached. If the total warm-up time has been reached, either closed-loop fuel control has begun or the engine is sufficiently warm for open-loop fuel control to near stoichiometric. A fuel with a high DI is sensitive to cold temperatures. At warmer engine temperatures, whether a fuel with a low or a high DI is used in the engine is irrelevant to the calculation of A/F ratio. Therefore, when the total warm-up time is reached, the control sequence ends, and normal operations resume. Total warm-up time varies significantly with the start-up coolant temperature and can range from 5 seconds to 25 seconds or longer. If the total warm-up time has been reached, the control sequence ends at step 40.

If the total warm-up time has not been reached, the engine is still in open-loop run mode. The control sequence advances to step 42 to begin monitoring at least one of the following indicators of fuel problems during this period: the misfire detection system, engine speed through the engine speed sensor 19, and manifold absolute pressure (MAP) through the MAP sensor 15. In a preferred aspect of the invention, all three indicators are monitored.

The misfire detection system detects abnormal combustion through monitoring such engine variables as the rate of change of crankshaft velocity, ion sense or in-cylinder pressure. In typical engine control algorithms, the misfire detection system is not monitored until after the engine is warmed. Since supplying a fuel signal to an engine during open-loop run mode based on a fuel with a low driveability index ("DI") may result in engine misfires, the misfire detection system can be used in this period to determine if more fuel is needed than that which the engine has been supplied. Monitoring the misfire detection system has the advantage that, during this period of engine operation, detection of a misfire would only indicate a fuel problem.

One disadvantage to solely monitoring the misfire detection system is that the misfire detection system may not always detect a misfire due to insufficient fueling in this period. In some engines, the engine design is such that the engine would not misfire, it would merely run "weak." Therefore, other engine variables can be monitored to serve as indicators of fuel problems. Specifically, if the engine speed droops, that is, it drops below a predetermined threshold speed, or if the manifold absolute pressure (MAP) exceeds a predetermined threshold pressure, more fuel is needed than that which the engine has been supplied. The thresholds used for the comparisons with engine speed and MAP are dependent upon the engine design, particularly upon the number of cylinders.

The control sequence monitors the chosen indicators in step 42 at predetermined intervals, typically 12.5 milliseconds. In a preferred aspect of the invention all three indicators are monitored. Therefore, in step 44, a query is made as to whether a misfire has been detected, or if the engine speed drops below a predetermined threshold speed, or if the MAP increases above a predetermined threshold pressure. If a misfire has not been detected, and the engine speed has not dropped below the predetermined threshold speed, and the MAP has not increased above the predetermined threshold pressure, the control sequence returns to step 38 to check whether the total warm-up time has been reached.

Returning now to step 44, if a misfire is detected, or the engine speed drops below the predetermined threshold speed, or the MAP increases above the predetermined threshold value, a maximum increase in fuel is determined in step 46. In a preferred aspect of the invention, the fuel increase determined in step 46 is based on the fuel with the highest DI expected, typically 1250 DI. In another aspect of the invention, the increase is determined based on known relationships between manifold absolute pressure, engine speed, coolant temperature, and fuel. In step 48, an increase in fuel is signaled. In one aspect of the invention, the amount of the increase is the maximum fuel increase determined in step 46. In another aspect of the invention, the fuel increase is made in incremental steps based on the desired performance of the engine using inputs manifold absolute pressure, engine speed and coolant temperature, with the high limit as the maximum fuel increase determined in step 46. After the fuel increase is completed, the control sequence ends at step 40.

What is claimed is:

1. A method of controlling an air-to-fuel ratio in an internal combustion engine during an open-loop run mode, comprising the steps of:

determining an air-to-fuel ratio based on a fuel with a low driveability index;

fueling the engine based on the air-to-fuel ratio;

monitoring at least one engine indicator to detect a problem with the air-to-fuel ratio; and increasing a level of fuel supplied to the engine to a maximum fuel level when the monitoring step detects a problem with the air-to-fuel ratio.

2. The method according to claim 1, wherein the step of fueling the engine to an air-to-fuel ratio based on a fuel with a low driveability index comprises the step of using a fuel with a driveability index from 1100–1150.

3. The method according to claim 1, wherein the step of monitoring at least one engine indicator to detect a problem with the air-to-fuel ratio comprises the steps of:

monitoring an engine misfire detection system; and detecting the problem when an engine misfire is detected.

4. The method according to claim 1, wherein the step of monitoring at least one engine indicator to detect a problem with the air-to-fuel ratio comprises the steps of:

monitoring an engine misfire detection system;

monitoring an engine speed;

monitoring a manifold absolute pressure;

detecting the problem when one at least one of an engine misfire is detected, the engine speed drops below a predetermined threshold speed, and the manifold absolute pressure rises above a predetermined threshold pressure.

5. The method according to claim 1, wherein the step of monitoring at least one engine indicator to detect a problem with the air-to-fuel ratio comprises the steps of:

monitoring an engine speed; and detecting the problem when the engine speed drops below a predetermined threshold speed.

6. The method according to claim 1, wherein the step of monitoring at least one engine indicator to detect a problem with the air-to-fuel ratio comprises the steps of:

monitoring a manifold absolute pressure; and detecting the problem when the manifold absolute pressure rises above a predetermined threshold pressure.

7. The method according to claim 1, wherein the step of increasing the level of fuel supplied to the engine by an increase factor comprises the step of determining the level of fuel supplied based on a fuel with a high driveability index.

8. The method according to claim 7, wherein the step of determining the level of fuel supplied based on a fuel with a high driveability index comprises the step of using a fuel with a driveability index of 1250.

9. The method according to claim 1, wherein the step of increasing a level of fuel supplied to the engine to a maximum fuel level comprises the step of increasing the level of fuel supplied in more than one incremental step.

10. An apparatus for controlling an air-to-fuel ratio in an internal combustion engine during an open-loop run mode, comprising:

means for determining an air-to-fuel ratio based on a fuel with a low driveability index;

means for fueling the engine based on the air-to-fuel ratio;

means for monitoring at least one engine indicator to detect a problem with the air-to-fuel ratio; and means for increasing a level of fuel supplied to the engine to a maximum fuel level when the monitoring step detects a problem with the air-to-fuel ratio.

11. The apparatus according to claim 10, wherein the means for fueling the engine to an air-to-fuel ratio based on a fuel with a low driveability index comprises means for using a fuel with a driveability index from 1100–1150.

12. The apparatus according to claim 10, wherein the means for monitoring at least one engine indicator to detect a problem with the air-to-fuel ratio comprises:

means for monitoring an engine misfire detection system;

means for monitoring an engine speed;

means for monitoring a manifold absolute pressure;

means for detecting the problem when at least one of an engine misfire is detected, the engine speed drops below a predetermined threshold speed, and the manifold absolute pressure rises above a predetermined threshold pressure.

13. The apparatus according to claim 10, wherein the means for monitoring at least one engine indicator to detect a problem with the air-to-fuel ratio comprises:

means for monitoring an engine misfire detection system; and means for detecting the problem when an engine misfire is detected.

14. The apparatus according to claim 10, wherein the means for monitoring at least one engine indicator to detect a problem with the air-to-fuel ratio comprises:

means for monitoring an engine speed; and means for detecting the problem when the engine speed drops below a predetermined threshold speed.

15. The apparatus according to claim 10, wherein the means for monitoring at least one engine indicator to detect a problem with the air-to-fuel ratio comprises:

means for monitoring a manifold absolute pressure; and means for detecting the problem when the manifold absolute pressure rises above a predetermined threshold pressure.

16. The apparatus according to claim 10, wherein the means for increasing the level of fuel supplied to the engine by an increase factor comprises means for determining the level of fuel supplied based on a fuel with a high driveability index.

17. The apparatus according to claim 16, wherein the means for determining the level of fuel supplied based on a fuel with a high driveability index comprises means for using a fuel with a driveability index of 1250.

18. The apparatus according to claim 10, wherein the means for increasing a level of fuel supplied to the engine to a maximum fuel level comprises means for increasing the level of fuel supplied in more than one incremental step.

19. An engine control system for controlling an air-to-fuel ratio in an engine, comprising:

a sensor that generates a signal upon occurrence of an engine misfire; and a controller that determines an air-to-fuel ratio based on a fuel with a low driveability index, that regulates a fuel supply to the engine based on the air-to-fuel ratio, and that adjusts the fuel supply to a maximum fuel level in response to said signal.

* * * * *